US011506450B1

(12) United States Patent
Aliberti

(10) Patent No.: US 11,506,450 B1
(45) Date of Patent: Nov. 22, 2022

(54) COOLING PACKAGE AND SENSOR PROBE

(71) Applicant: KOI Creations, Inc., Walpole, MA (US)

(72) Inventor: Christopher Aliberti, Scottsdale, AZ (US)

(73) Assignee: KOI CREATIONS, INC., Walpole, MA (US)

( * ) Notice: Subject to any disclaimer, the term of this patent is extended or adjusted under 35 U.S.C. 154(b) by 222 days.

(21) Appl. No.: 16/807,525

(22) Filed: Mar. 3, 2020

(51) Int. Cl.
*F25D 29/00* (2006.01)
*F25D 3/08* (2006.01)

(52) U.S. Cl.
CPC ..... *F25D 29/005* (2013.01); *F25D 3/08* (2013.01); *F25D 29/003* (2013.01); *F25D 2303/08222* (2013.01); *F25D 2700/122* (2013.01)

(58) Field of Classification Search
CPC ..... B65D 90/48; F25D 31/00; F25D 2400/12; F25D 2700/12; F25D 3/08; F25D 29/008; F25D 29/003; F25D 2303/0822; A61F 7/10–2007/108; A61G 2201/5082; A61H 2201/5082
USPC ..... 62/529, 590
See application file for complete search history.

(56) References Cited

U.S. PATENT DOCUMENTS

2009/0048650 A1 2/2009 Junkins
2020/0163829 A1* 5/2020 Nathanson ..... F25D 3/08

FOREIGN PATENT DOCUMENTS

WO WO9935453 * 7/1999 ..... A01N 1/0252

OTHER PUBLICATIONS

Seidio Smart Bottle, www.seidioonline.com/product/seidio-smart-water-bottle/, (visited Mar. 3, 2020.
Michael Lu, et al., Milk Spoilage: Methods and Practices of Detecting Milk Quality, Food and nutrition Sciences, 2013, 4, 113-123, http://dx.doi.org/10.4236/fns.2013.47A014.
Smart Vacuum Flask Water Bottle With Touch Screen Temperature Display, https://theurbansales.com/product/smart-vacuum-flask-water-bottle-with-touch-screen-temperature-display/ (visited Mar. 3, 2020).

* cited by examiner

*Primary Examiner* — Cassey D Bauer
(74) *Attorney, Agent, or Firm* — Brooks Kushman P.C.

(57) ABSTRACT

A cooling package that includes a sensor that provides a signal to the user to indicate that the cooling package is ready for use and when the cooling package is depleted is described. The sensor and sensor display are selected on the basis of the freezing point of the contained solution. The freezing point of the solution is adjustable through use of organic or inorganic additives. The sensor can further be used by placement directly in contact with a food product and through measurement of temperature, pH or electrical conductivity a signal to the user through the built in display warns of food spoilage if the temperature, cumulative time above a pre-selected temperature, pH or electrical conductivity exceed a pre-selected limit.

14 Claims, 11 Drawing Sheets

100

103

1000

COOLING PACKAGE AND SENSOR PROBE

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Technical Field

The invention generally relates to the fields of portable cooling packages such as ice packs used for food storage.

Background of the Invention

The use of cooling packs ranging from simple blocks or bags of ice to portable electronic refrigerators are common for preserving foods and drinks when travelling, camping, tailgating or other activities away from a home based refrigerator. Leaving food out too long at temperatures above 0 to 40° C. can cause bacteria, such as *Staphylococcus aureus, Salmonella Enteritidis, Escherichia coli*, and *Campylobacter*, to grow to dangerous levels that can cause illness. The use of cooling packages that include a container, typically made of a thermoplastic material, and, filled with an aqueous solution that in many cases further includes either organic additives or inorganic salt additives to lower the freezing point are common. The cooling packages may be pre-filled with a cooling solution or filled by the user and placed into a home freezer to attain a cold temperature prior to use in a cooler or other portable package for food storage. All too frequently, such cooling packages, however, do not provide reliable cooling and therefore food preservation. The cooling capacity of the packages rely on both the heat of fusion of the solution contained inside as well as the heat capacity of both the solid and liquid forms of the cooling solutions contained within and the package material itself. By far, the most significant cooling capacity comes from the heat of fusion of the solution. Full cooling capacity requires that all of the solution within the package is frozen solid. Opacity and stiffness of the cooling package frequently makes it difficult or impossible to tell whether the solution is fully frozen to provide full cooling capacity.

Additionally, during use, it is difficult to tell how much cooling capacity remains. Once all of the solid cooling solution has melted the temperature within a cooler can rise rapidly. Predicting when the cooling package will be, or, has been "depleted", and, the container being cooled by the cooling package becomes unsafe to preserve foodstuff is difficult to determine by just look and feel.

Frequently a user of such cooling packages will want to be able to adjust the cooling temperatures. Storing beverages in a cooler that is too cold can result in freezing of the beverages and perhaps even breakage of the beverage container. However, for longer term storage of food products, such as for a long camping trip, a much colder, even sub-freezing temperature may be required to keep the food safe for consumption. However, without properly freezing the package prior to use, the full cooling capacity of the cooling package will not be realized.

Frequently a user will also want to be able to adjust both the temperature and the size of the cooling package.

There is a need for a cooling package that includes an accurate indicator that the package is ready for use. There is a need for a cooling package that includes an accurate indicator that the cooling capacity of the cooling package is depleted. There is a need for a cooling package that has an adjustable target temperature, and, the indicators of ready to use and remaining capacity for any of the selected target temperatures. There is a need for an indicator and sensor probe that can be used by the user to tell that a stored food product has been too warm for too long a length of time, and, is, in fact, now unsafe for consumption.

BRIEF SUMMARY OF THE INVENTION

The invention includes a collapsible cooling package that is filled with a fluid and placed in a freezer compartment of a refrigerator until ready to use. The invented cooling package includes a sensor probe that extends into the interior of the cooling package that is attached to a display that is incorporated into the screw cap of the collapsible cooling package. In a preferred embodiment the sensor is a temperature sensor and the display shows the temperature of the contents of the cooling package at the distal end of the sensor probe. The sensor probe is sized to terminate at the point in the package that is known to be the last to freeze. In this way the temperature on the display is an indicator when the entire cooling package is fully frozen and ready for use. In a preferred embodiment the temperature, with the probe so placed, indicates the entire package is in the range of 0 to 5° C. The display includes indicia that show the temperature within the cooling package and indicia showing safe and unsafe conditions for food storage. In another embodiment a method for using the cooling package includes adding a fluid within the cooling package, the fluid having a pre-selected freezing point that corresponds to an indicia on the display, such that the sensor, display, and, fluid are custom selected for a particular pre-selected operating range of the cooling package. In one embodiment the fluids include pre-selected mixes for a first lower temperature for frozen storage of (preferably 0° C.) and a second higher temperature for food storage (preferably 4° C.). In another embodiment, the fluid for the cooling package, the sensor probe, and, the display are all preselected for operating temperature of a particular range. In another embodiment, the fluid for the cooling package, the sensor probe, the display, the amount of fluid and the size of the cooling package are all preselected for operating temperature of a particular range and cooling for a particular time duration. In one embodiment the size of the package is adjusted by collapsing or expanding a package with accordion walls.

Another embodiment further includes an electronics module operably placed between the sensor probe and the display. In one embodiment the sensor probe is one selected from a temperature probe, a pH probe, and, an electrical conductivity probe, and, the electronics module is programmed to accept an electrical signal from the probe and compare that signal against pre-selected limits that are indicative of food spoilage. In one embodiment the electronics are incorporated into a screw cap and use a sensor probe sized and adapted to fit a milk container and the electronics module is further programmed to cause the display to show an alarm signal indicative of milk OK to use and milk that is spoiled.

Various objects, features, aspects, and advantages of the present invention will become more apparent from the following detailed description of preferred embodiments of the invention, along with the accompanying drawings in which like numerals represent like components.

DETAILED DESCRIPTION

The present invention provides according to one or more of the following embodiments, systems, hardware, and related methods for easy to use cooling packages that include sensors for improved performance of the cooling package and enhanced food storage safety. The details of the embodiments describe of the use of the sensor primarily in a cooler package that is frozen in a home freezer for use in portable insulated containers as are known in the art. One example is shown of using the sensor in the food package itself to detect spoilage. Commonly numbered items in all the Figures refer to the same item or functionality throughout the description, although the item may not be identical in all applications.

Figure 1:
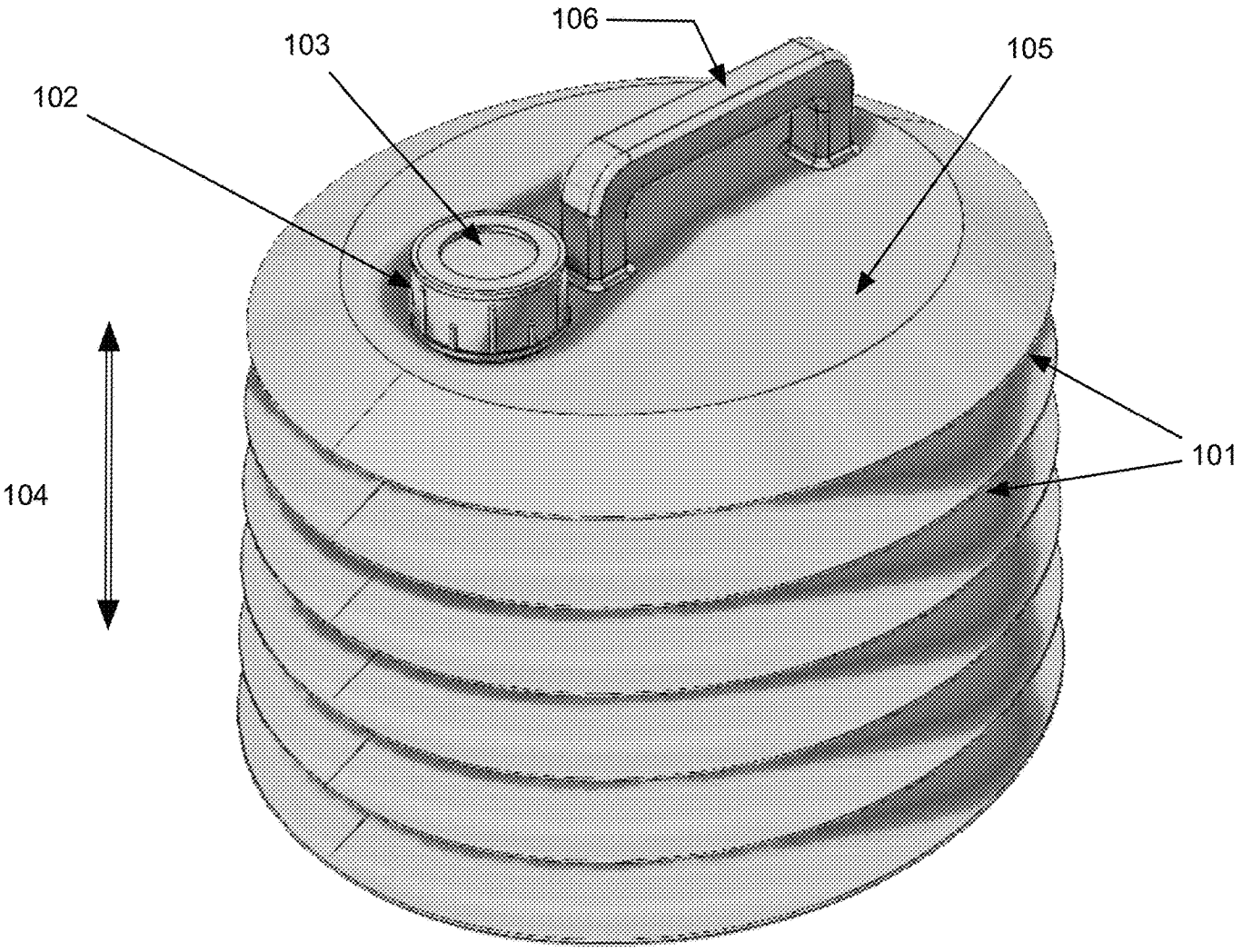
FIG. 1 shows a first embodiment of the cooling package with sensor probe.

FIG. 1 shows a perspective view of a cooling package 100. The cooling package includes a container 105 that is typical made from a molded or blow molded thermoplastic material that includes walls that include accordion ridges 101. The ridges provide increased surface area for transfer of heat from the outside of the container to the interior. The ridges also allow adjustment in the height 104 and therefore total volume of the container 105. Pushing down on the handle 106 causes the ridges to be compressed together and lowers the height 104 of the container 105. The cooling system further includes a cap 102, typically a plastic screw cap that has an opening through which a display 103 can be seen. The display showing the measured value for the sensor attached to the display as seen in later figures. In a preferred embodiment the display 103 shows the temperature of the sensor probe. The container is filled with a solution that is to be frozen. The solution is typically that known in the art to be used in refrigerator ice packs. The solution contains either organics, or, inorganic salts, or, both, whose concentration is varied to adjust the freezing point of the solution. In a preferred embodiment the sensor and/or the display are chosen to be used with the particular selected solution, and, include indicia that indicate that the solution has reached a pre-selected value where the contents of the cooling package will be completely frozen, and, the cooling package has attained its optimum cooling capacity. The display further includes indicia that indicate a depletion of the cooling capacity during use such that the cooling package may need to be refrozen to ensure continued cooling and an indicia that indicates the cooling package is fully warmed to ambient and the food stored in association with the cooling package might be unsafe.

Figure 2:
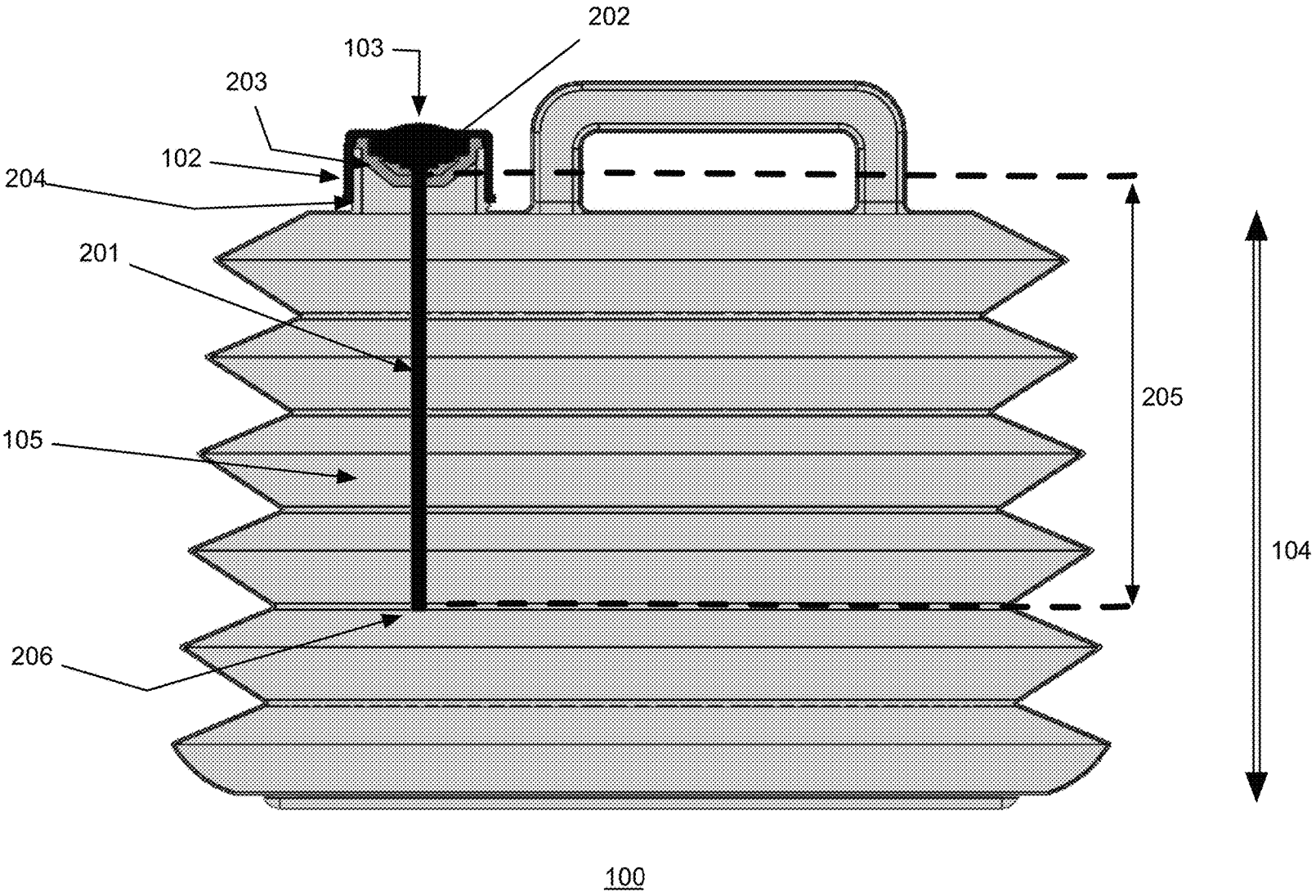
FIG. 2 shows a transparent view of the cooling package of FIG. 1.

FIG. 2 shows a side cross-sectional view of the cooling package 100. The sensor probe 201 is seen to extend into the interior of the container 105. In the preferred embodiment the sensor probe is a temperature measuring device where the display 103 shows the temperature within the container 105 at the location of the distal end 206 of the probe. The distal end 206 of the probe is located at a selected distance 205 such that the distal end of the senor probe 201 is at a distance 205 from the top of the container. The distance 205 can be adjusted by selecting a sensor probe having a chosen length and adjusting the overall height of the container by pressing or raising he handle of the container to adjust the height of the container up or down in the direction 104. In a preferred embodiment the height 205 is selected such that the distal end 205 of the sensor probe is located within the container 105 at the point known to freeze last. Such that the temperature at the location of the distal end 206 of the sensor probe is therefore an indicator that the solution within the container 105 is fully frozen and the cooling package is at its maximum cooling capacity. The sensor includes the probe 201, a sensor body 202 and a display 103. The sensor body includes either mechanical, thermomechanical, electronic components or other fluid or chemical components that control the display 103 to show the measured conditions at the probe tip 206. In a preferred embodiment the sensor body includes a thermomechanical linkage. The cooling package further includes a gasket 203 that fits against surfaces of the cap 102 and a threaded spigot 204 on the container 105 to create a water tight seal of the sensor and sensor probe to the container 105.

Figure 3:
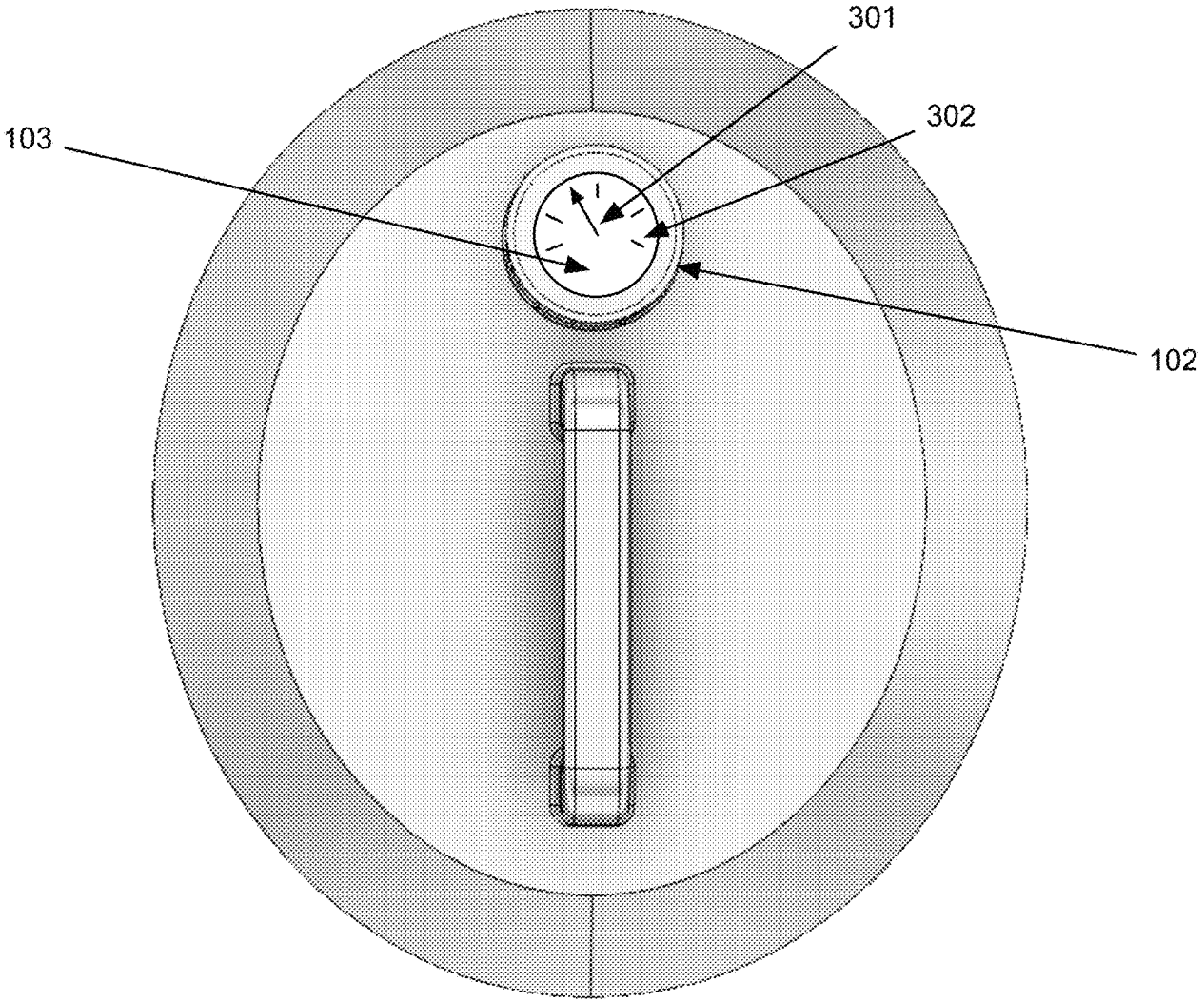
FIG. 3 shows a top view of the cooing package and sensor display.

FIG. 3 shows a top view of the cooling package 100. The display 103 is mounted to the top of the sensor probe and in a preferred embodiment held in place by the screw cap 102. The display is visible through the cap, as shown, and includes an indicator 301, here shown as a pointing arrow, and indicia 302 that are indicative of the condition, typically temperature, at the tip of the probe as shown in FIG. 2. Details of the display and indicia are shown in FIG. 7.

Figure 4A:
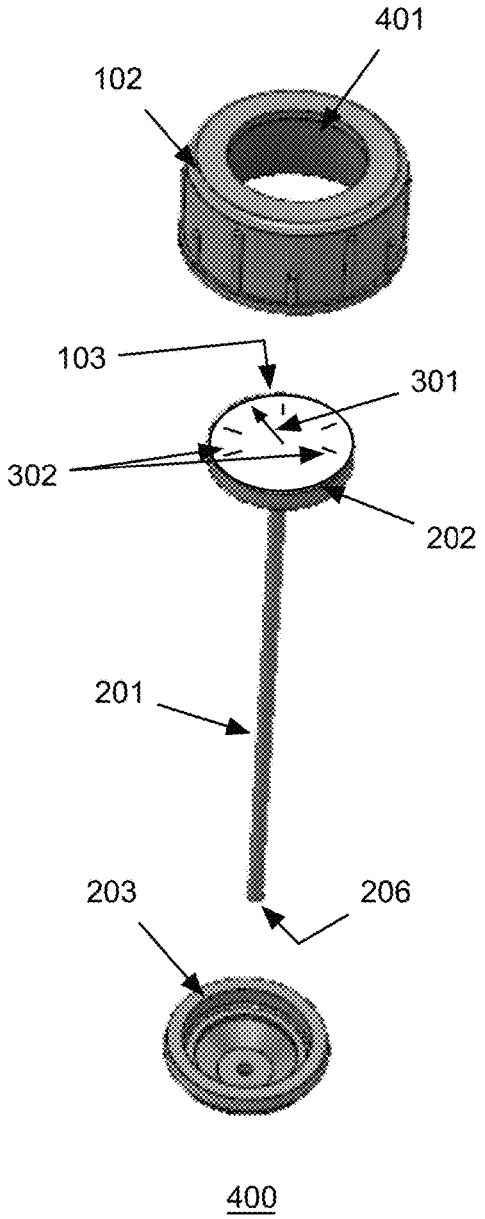
FIGS. 4A and 4B shows an exploded view of the cap, sensor, and, sealing gasket of the cooling package.
Figure 4B:
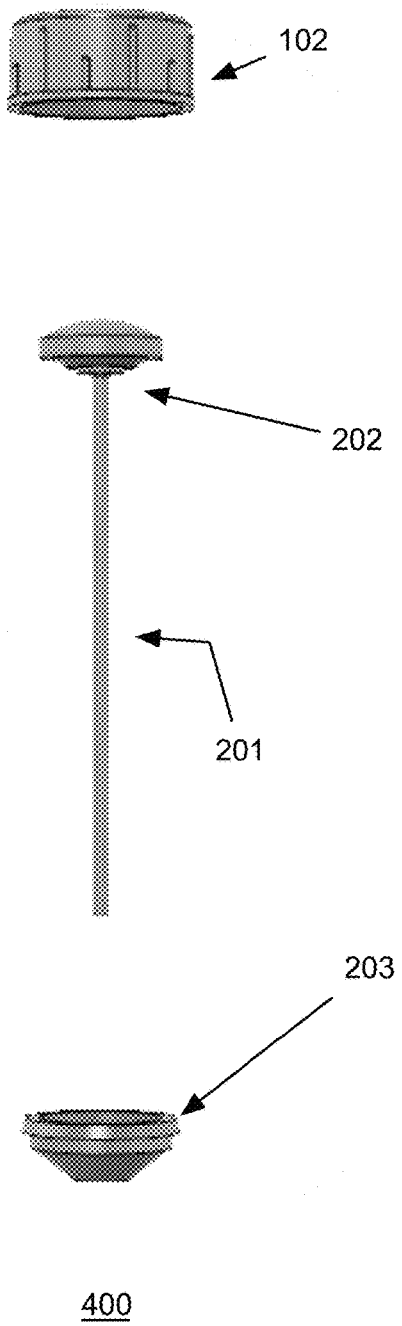
Figure 5:
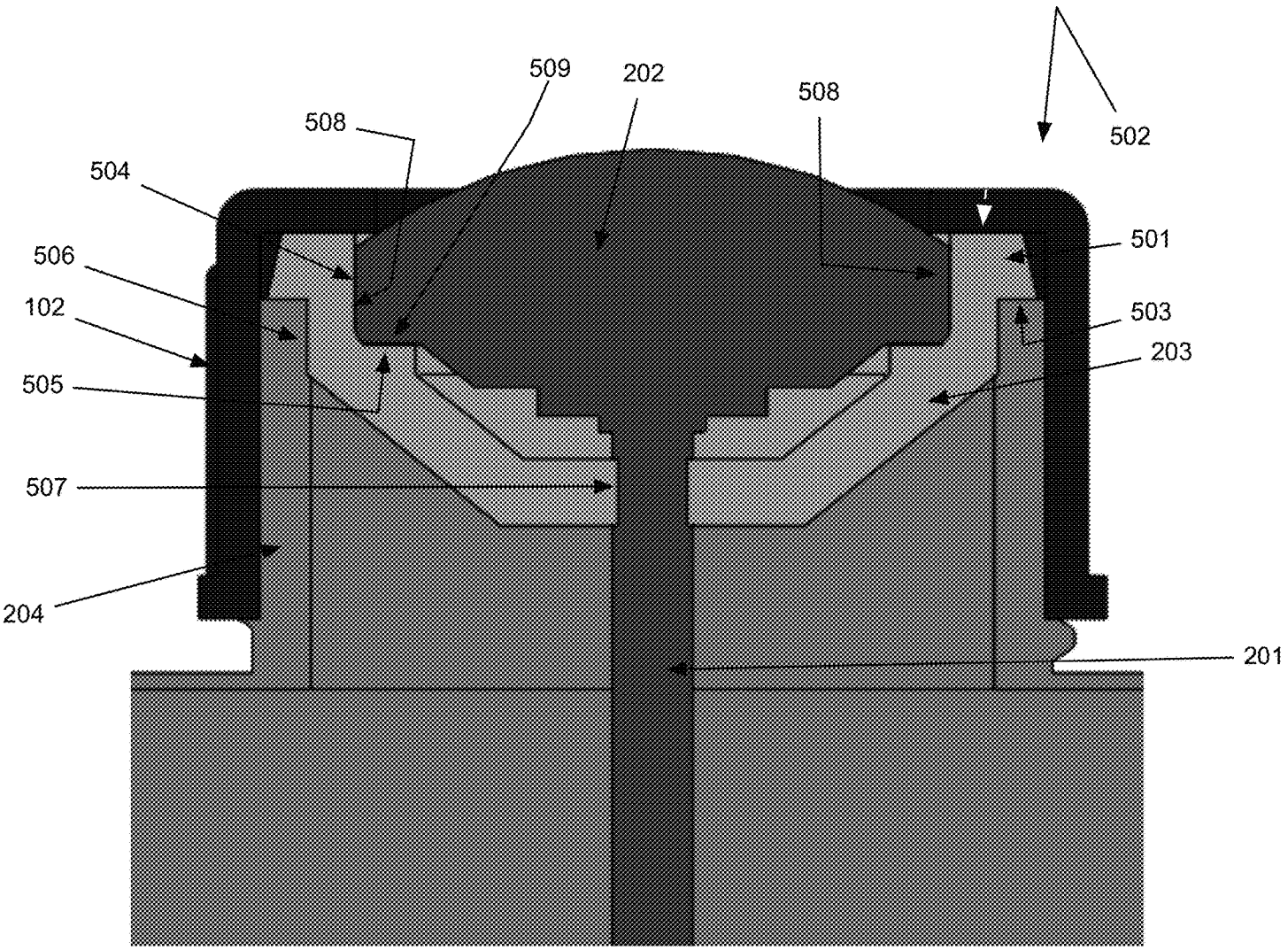
FIG. 5 shows a cross-sectional view of the assembled cap, sensor and sealing gasket.
Figures 6A, 6B:
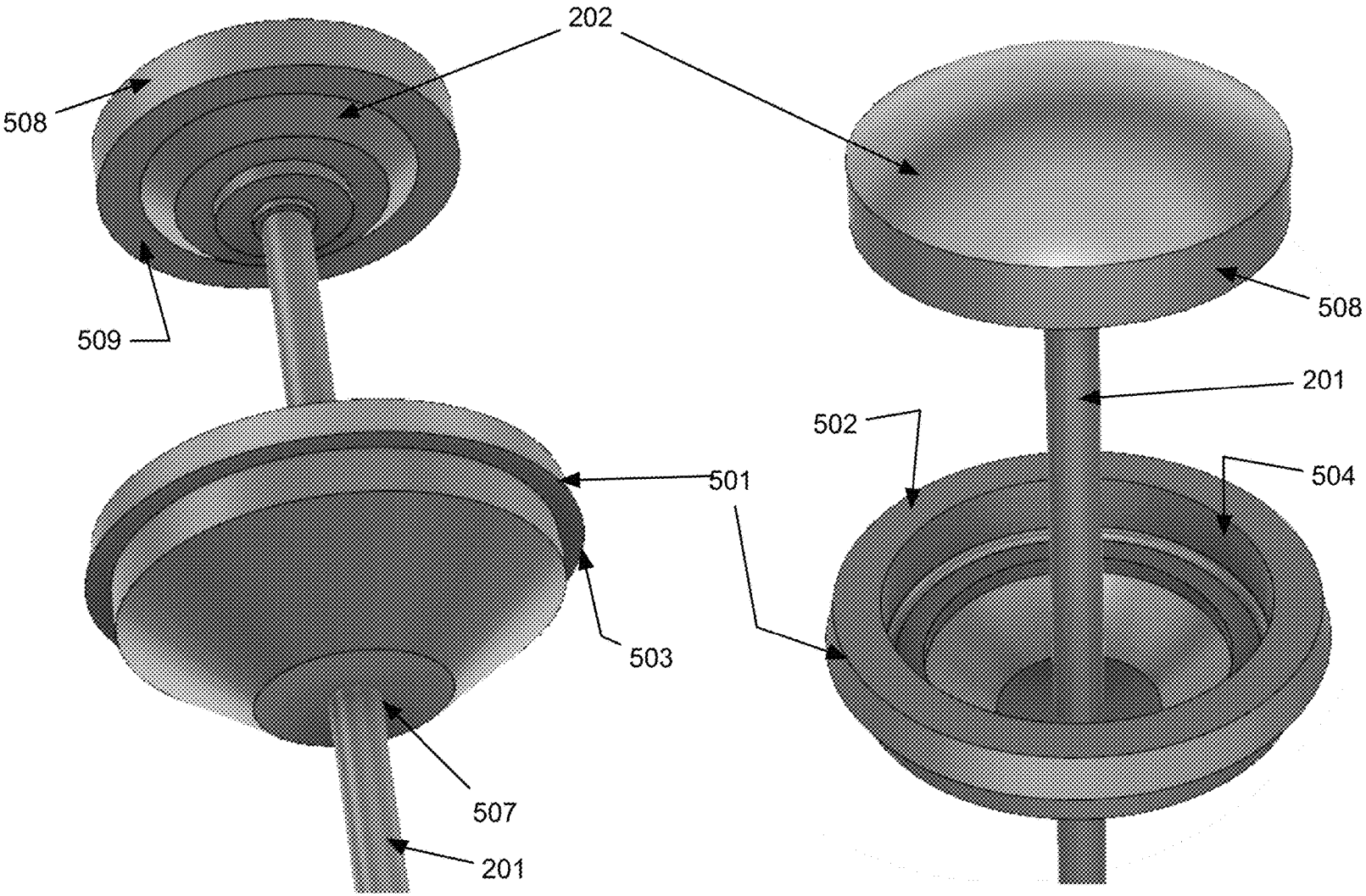
FIGS. 6A and 6B shows perspective views of the sensor and gasket.

FIGS. 4A and 4B show exploded views of the sensor, the cap, and, the seal. The sensor assembly 400 includes a sensor probe 201, attached to a sensor body 202, the sensor body including a display 103, a screw cap 102, and, a seal 203, shaped to fit to the bottom of the sensor body 202 and seal against the interior of the cap 102, and, against a threaded port or spigot (item 204 in FIG. 2) on the cooling package container. The display includes, in the preferred embodiment, indicia 302, and, an indicator, here, a needle indicator 301. In a preferred embodiment the sensor is a temperature sensor and alignment of the needle indicator with the indicia are indicative of the temperature at the distal end 206 of the sensor probe. In a preferred embodiment, the indicia 302 are selected on the basis of the freezing point of the solution contained within the cooling device container, and, indicate: 1. When the cooling device is fully frozen and ready for use, 2. when the cooling device is warming above the freezing point of the solution within the container and is losing cooling capacity, and, 3. When the temperature of the device is too high and food spoilage is a risk. The sensor assembly further includes a screw cap 102 that includes a hole 401 in its top surface for viewing the display 103. FIGS. 5, 6A and 6B shows details of the fitting of the sensor assembly within the cylindrical port 204 that is formed in the top of the cooling package container 105 (see FIG. 1). The sealing gasket 203 is comprised of a generally cup shaped body made of a compressible rubber-like material that includes a plurality of sealing surfaces. The top rim of the cup includes a ridge 501 having a top surface 502 that seals against the inside surface of the cap 102 and a bottom surface 503 that seals against the top surface of the threaded spigot 204 when the cap 102 is screwed onto the spigot 204. The sealing gasket 203 further includes an inside vertical surface 504 that seals against the outer vertical surface 508 of the sensor probe body 202 and a horizontal surface 505 that seals against the bottom surface 509 of the sensor probe body 202. The sealing gasket 203 further includes a hole 507 centered in the bottom of the sealing gasket and sized to seal around the sensor probe 201 as it extends into the inside of the cooling device container.

Figure 7:
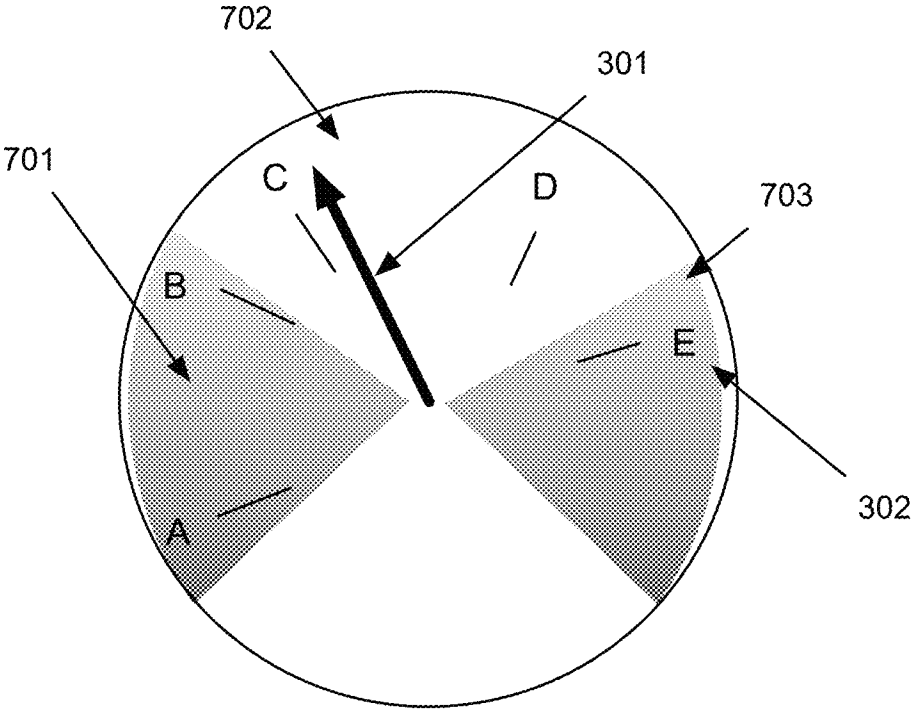
FIG. 7 shows a top view of the sensor display.

FIG. 7 shows details of a preferred embodiment of the display 103. The display includes and indicator 301 that points to indicia 302 on the face indicating the measured state of at the distal end of the sensor probe discussed earlier. In the preferred embodiment the sensor probe is a temperature probe and the indicia, here labeled generically A-E, are temperatures at which the solution within the cooling package are:

A—solution is below the freezing point,

B—solution is at freezing point,

C—solution is above the freezing point and cooling package is losing cooling capacity, D—solution is above freezing point and at the boundary of safe food storage, and, E—solution is too warm to safely store food products, spoilage may occur.

The display is further divided into zones 701-703, Where the first zone 701 indicates the cooling package is ready to use, the second zone 702 indicates the cooling package is warming as would be observed in use, but still providing sufficient cooling to prevent rapid spoilage and a third zone 703 where the cooling package is depleted and should either be re-frozen or replaced with a freshly frozen cooling package. The position of the indicia and the range of the indicator needle 301 are selected on the basis of the particular solution being used within the cooling package. The display is customized for the particular solution. Being used within the cooling package. In a preferred embodiment the cooling package includes a selection of pre-measured mixes to be used within the cooling package and for each of the pre-measured mixes a sensor probe customized with a display face 103 including indicia 302, and, zones 701-703, mechanics to move the indicator needle based upon the range of operating temperatures of the cooling package with the particular selected pre-measured mix. In one embodiment at least two pre-measured mixes are available called A and B and the indicia A would indicate when pre-mix A is ready for use and indicia B would indicate when premix B is ready for use. Similarly, the remaining indicia are an indication of the state of the cooling package relevant to one mix or the other. In one embodiment the highest temperature indicating indicia, here labeled E indicates the cooling package has reached a temperature where there is significant risk of food spoilage. In a preferred embodiment indicia E indicates the food cooling package is above 40° F.

Figure 8A:
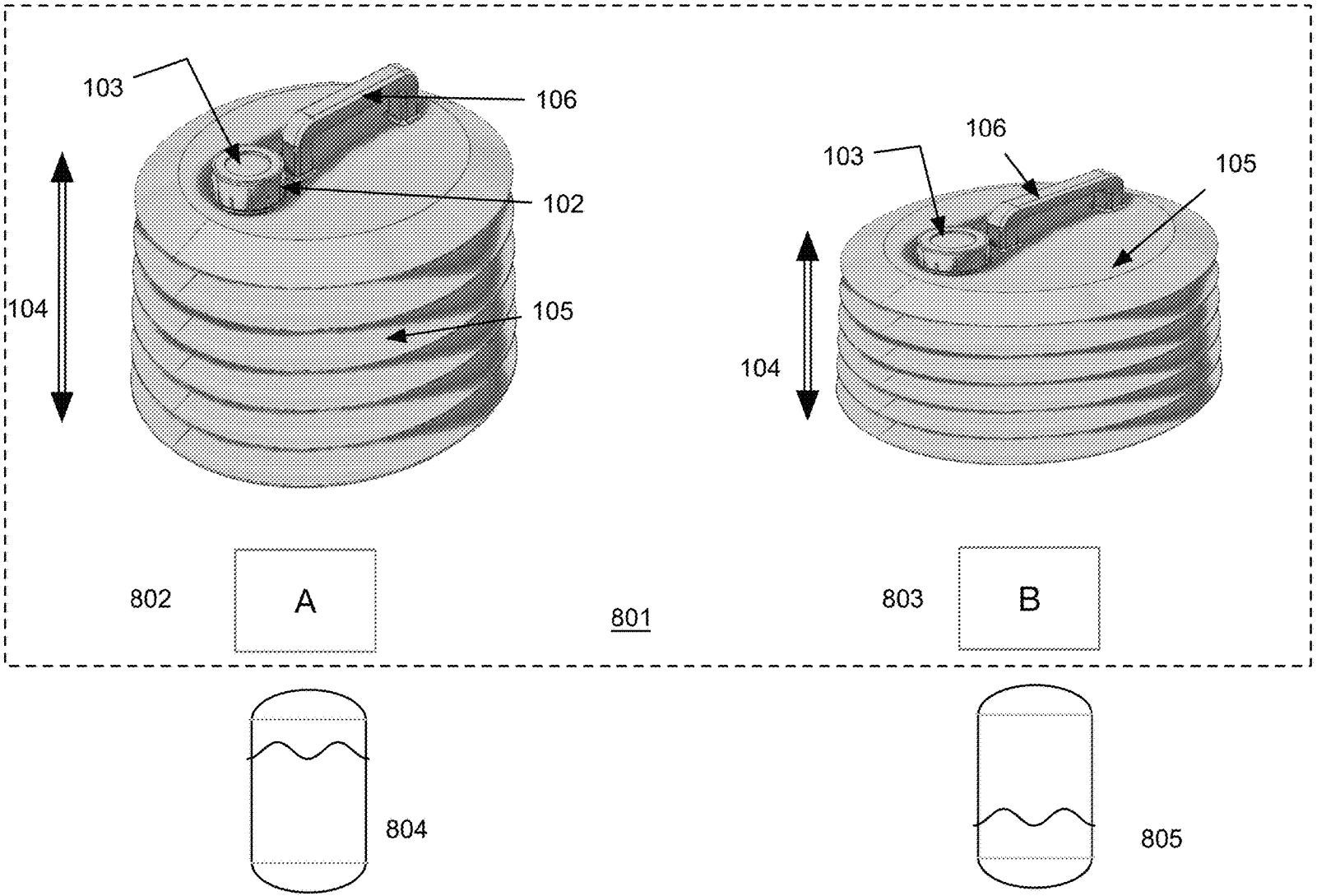
FIGS. 8A and 8B show methods of using the invented cooling package.
Figure 8B:
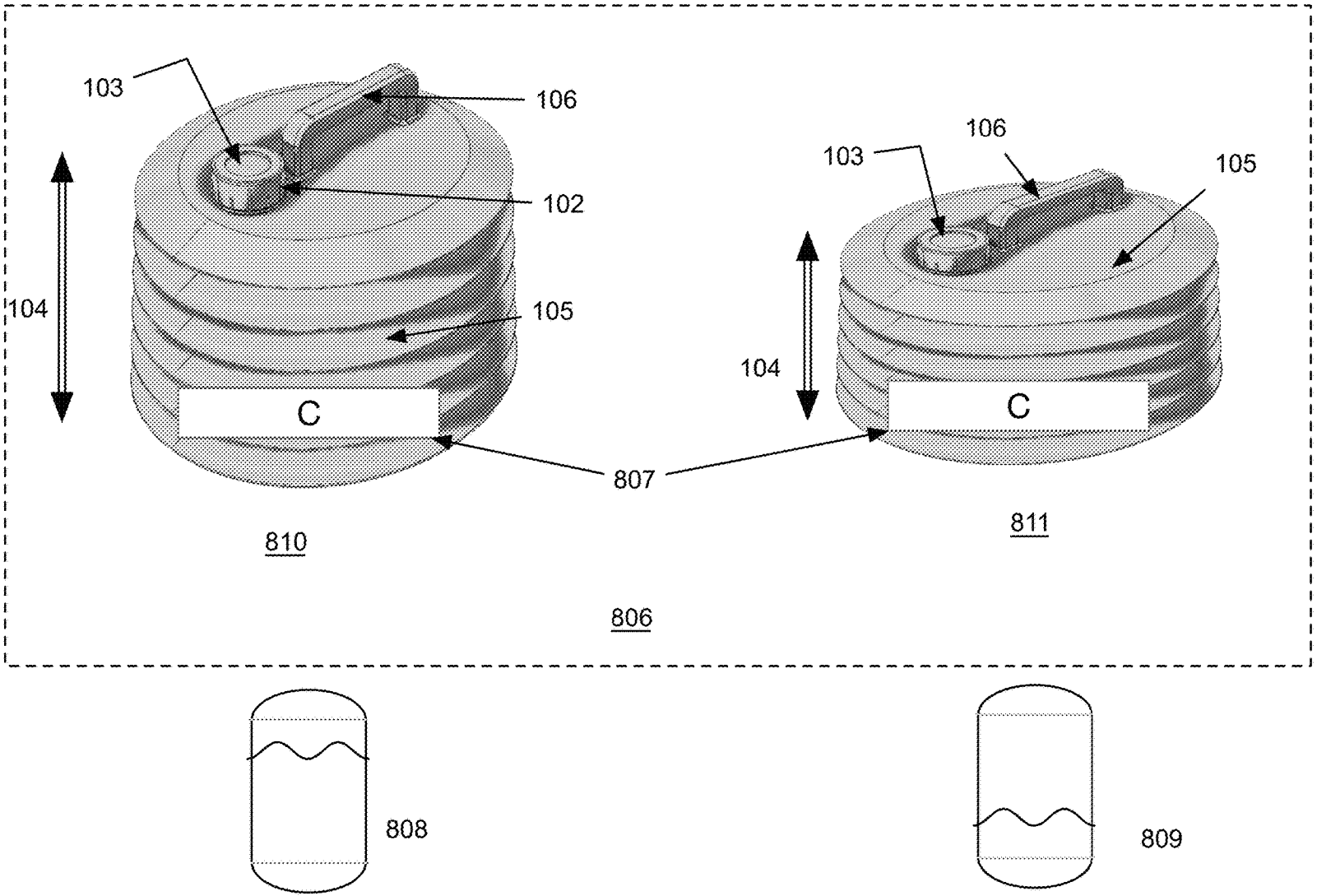

FIGS. 8A and 8B show two methods of using a cooling package system that includes an accordion container 105 having, as already described, a temperature probe including a display 103. The display is as described in FIG. 7. The height 104, and therefore the volume, of the accordion container 105 is adjustable by pushing down or pulling up on the handle 106. The cooling package system further includes a plurality of additive mixes 802, 803, here two are shown. The cooling package is prepared for use by selecting an additive mix, either A 802 or B 803. The mix is selected on the basis of a desired operating temperature and/or a cooling capacity. The mix is combined with a prescribed volume of water (804 for mix A and 805 for mix B) such that the combined volume of water and additive mix when fully dissolve, will produce a solution that has a pre-selected freezing point. The height 104 and therefore the volume of the cooling package container 105 is adjusted to expel air from the container with the cap 102 loosened or removed and then the cap is replaced to produce a sealed solution. The mix of additive A 802 with the prescribed amount of water 804 when fully frozen will be ready to use when the indicator on the display 103 is pointing to the indicia A and the mix of additive B with the prescribed amount of water 805 will, when frozen, be ready to use when the indicator on the display 103 is pointing to the indicia B. The preparations A or B so produced will be partially depleted as to cooling capacity when the indicator points to indicia C and D respectively. And, either solution preparation A or B is fully depleted when the indicator points to indicia E. The particular wording of the indicia on the display may be any that indicates 1. When the cooling package is ready for use, 2. When the cooling package is partially depleted and 3. When the cooling package is fully depleted at food spoilage may occur.

In another embodiment shown in FIG. 8B, the cooling package 806 includes a pre-measured amount of additive 807 added to the container 105 with a prescribed amount of water 808, 809 to be added by the user. The amounts of water include options of a larger amount 808 or a smaller amount 809. Once the water is added, the height 104, and, therefore volume of the container 105 is adjusted such that the water level is at the height of the cap 102 and the cap, with sensor probe, is screwed to the container 105. In the preferred embodiment the additive and the larger amount of water produces a first cooling package 810 that uses 7 quarts of water, has a first freezing point of −5° C. and weighs 16 lbs and the same cooling package materials, using 6 quarts of water produces a second cooling package 811 that has a second freezing point of −6° C. and weighs 13.5 lbs. The combination of a container 105 with an adjustable 104 size and adjustable amounts of additive and water enables a cooling package that can be customized for applications over a wide range of operating temperatures and sizes. The temperature probe indicates when any of the particular selected operating temperatures are ready to use, partially depleted and unsafe for the selected use.

Figure 9:
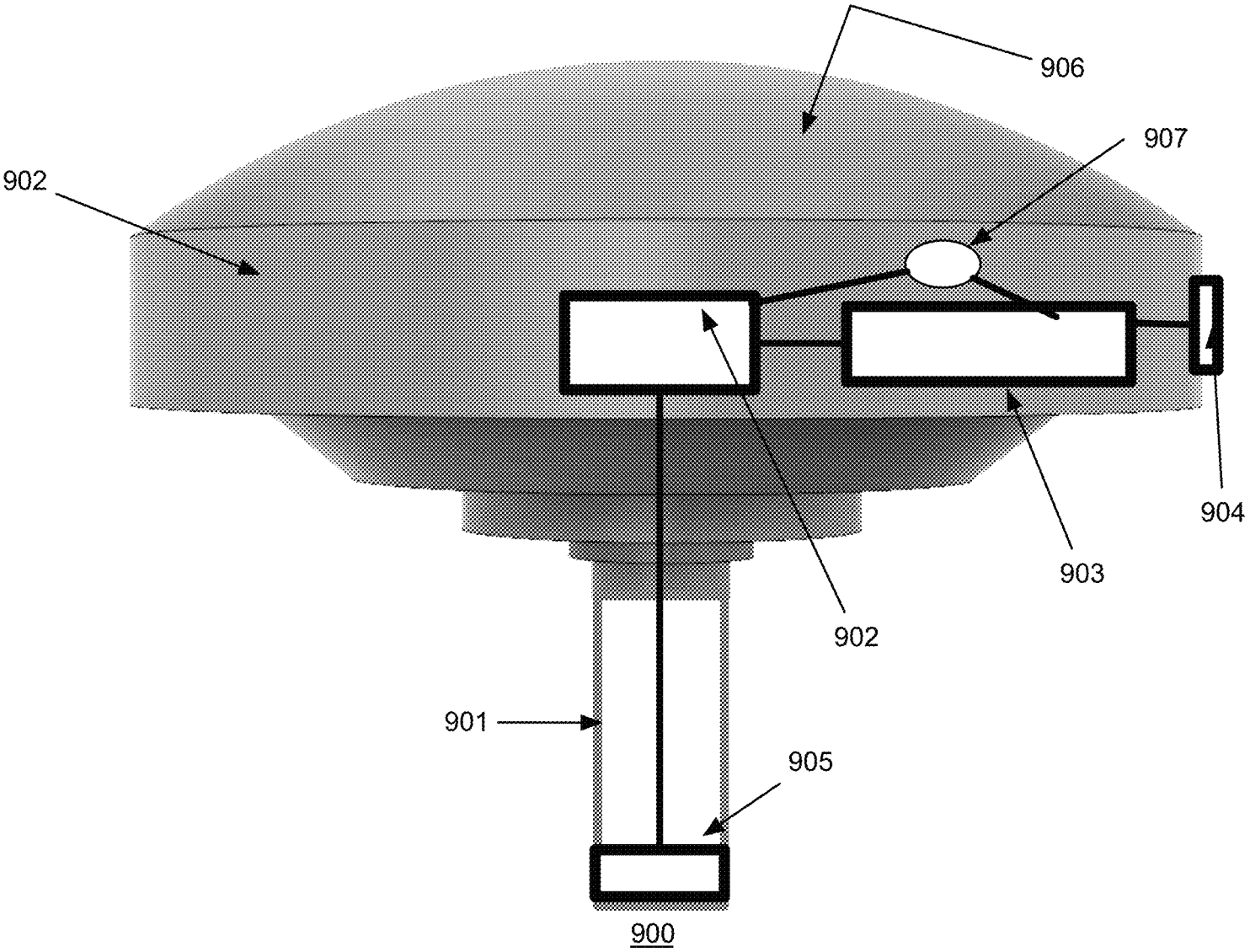
FIG. 9 shows an embodiment of the sensor including electronics and a user interface.

FIG. 9 shows an embodiment of a sensor probe 900 that further includes electronics that can process a signal from a sensor 905 where the sensor is any selected from a thermal sensor, a pH sensor, a conductivity sensor. The sensor body 902 in the example is the same shape as those previously described (item 202, FIG. 2) and uses the same sealing gasket, again as already described. The Sensor is included in a sensor probe 901 and is connected to an analog to digital converter 902, a microprocessor 903, a user interface 904, a display 906, and, a battery 907 to power the electronics. In one embodiment the display 906 is the same display as previously described including a needle indicator and indicia. In this case the display shows, however, a measure from the sensor 905 that is indicative of spoilage of a food product into which the sensor through the sensor probe is inserted. In one embodiment the sensor 905 is a pH probe and the electronics receive a voltage signal from the pH sensor that is processed to indicate the pH of the food product and the pH is indicative of the safety of the food product for consumption. In one embodiment the food product is milk and the pH probe indicates the relative concentration of lactic acid in the milk, excess lactic acid indicative of spoilage. Spoilage is indicated as the pH of the milk decreases from a normal range of 6.5 to 6.8 to below 6.5, such as a pH of 5. The indicia in the display are selected to show good, drinkable milk, at pH's above approximately 6.5 and spoiled milk at pH's below approximately 6.0, and milk that is well on its way to spoiled with measured pH between those points. In another embodiment the sensor is an electrical conductivity sensor and as the milk spoils, the added lactic acid causes an increase in the conductivity of the solution. The electronics are programmed to display a warning to the user that the milk product within the container is spoiled when the conductivity exceeds a pre-selected level.

In another embodiment the probe is a temperature probe and the electronics through use of a thermal probe acquire time and temperature data. It is known in the art that food spoilage is a function not just of an elevated temperature but also how long the food has been stored at an elevated (typically above 40° F., but dependent upon the type of food product). In one embodiment the sensor electronics sum up the total amount of time that a food product is above a pre-selected temperature. A cumulative time for food held above 40° F. is indicative of spoilage and the display includes an indicator and indicia that are read to indicate the food has been, cumulatively, too warm for too long.

In another embodiment the user interface 904 is a button that, when pressed, causes a measurement to be made and the result displayed on the display 906.

Figure 10:
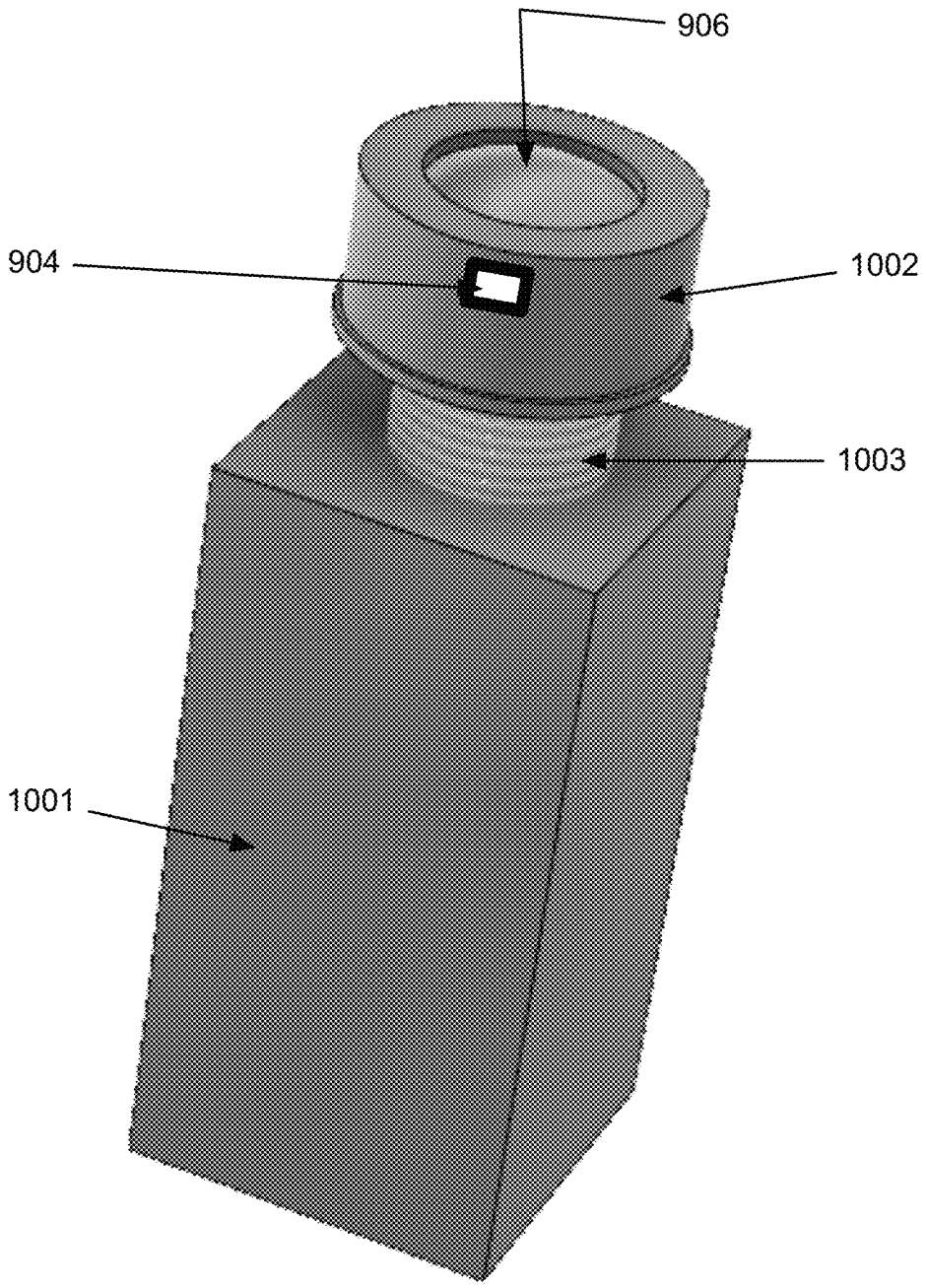
FIG. 10 shows an embodiment of the sensor used with a food container.

FIG. 10 shows an image of the invented probe 900 of FIG. 9, attached directly to a food package 1001 through a screw top 1002 and threaded spigot 1003. In the embodiment shown the probe includes a user interface 904 and a display 906. In one embodiment the display includes a graphics display. In another embodiment the display include an LED display where if the food product is ok the LED is green when the user interface button is pushed and if the food product is spoiled the display will show red and optionally flash on and off. In one embodiment the probe 905 is a pH sensor and good and bad are determined by the pH of the food product in the container. The case of detecting food spoilage using pH and where the food product is milk was discussed earlier. In another embodiment the sensor probe 905 includes an electrical conductivity sensor. In another embodiment the sensor is a temperature probe. In another embodiment the sensor includes any of a temperature probe, an electrical conductivity probe and a pH probe and spoilage is indicated if any of the temperature, pH and electrical conductivity is outside of pre-selected ranges for temperature, pH and electrical conductivity. In another embodiment the sensor is a temperature probe and the sensor includes a computing device that determines spoilage on the basis of the integrated time the product in the container is above a pre-selected temperature. In another embodiment spoilage is defined as freezing of the product and the product is determined to be spoiled if it has been frozen and thawed more than a pre-selected number of freeze-thaw cycles.

SUMMARY

A cooling package that includes a sensor that provides a signal to the user to indicate that the cooling package is ready for use and when the cooling package is depleted is described. The sensor and sensor display are selected on the basis of the freezing point of the contained solution. The freezing point of the solution is adjustable through use of organic or inorganic additives. The sensor can further be used by placement directly in contact with a food product and through measurement of temperature, pH or electrical conductivity a signal to the user through the built in display warns of food spoilage if the temperature, cumulative time above a pre-selected temperature, pH or electrical conductivity exceed a pre-selected limit.

I claim:

1. A cooling package comprising:

a container having a top, a bottom and walls connecting the top and bottom and defining an interior volume therebetween, and a spout providing access to the interior of the container, and, an additive at least one selected from: an inorganic water soluble salt, and, an organic water soluble compound, a pre-selected amount of additive mixed with a pre-selected amount of water, and, place inside the container, the amount of water and amount of additive selected such that the freezing point of the additive and water solution is at a preselected value, and, a temperature sensor removably attached to the spout, the sensor having a tip extending into the interior volume of the container to a depth between the bottom and the top of the container, and, a display in communication with the temperature sensor and indicating a temperature of the solution, the display having a plurality of indicia corresponding to a plurality of temperature ranges including at least a first temperature range below the freezing point of the additive and water solution, a second temperature range above the freezing point of the solution, but less than a pre-selected temperature, and a third temperature range greater than the pre-selected temperature.

2. The cooling package of claim 1, wherein the container the walls have an accordion shape and allow the height and therefore the volume of the container to be adjustable.

3. The cooling package of claim 1, wherein the spout has a threaded portion that cooperates with a threaded cap, wherein the temperature sensor is attached to the spout is through the threaded cap.

4. The cooling package of claim 1 wherein the display shows an alarm signal if the temperature of the additive and water solution within the container is greater than a pre-selected temperature limit.

5. The cooling package of claim 4 further comprising a controller in communication with the temperatures sensor and programmed to calculate the total time the temperature of the additive and water solution is above the pre-selected temperature limit.

6. The cooling package of claim 5 wherein the display shows the alarm signal if the total time the additive and water solution is above the pre-selected temperature limit is greater than a pre-selected time limit.

7. The cooling package of claim 2, wherein the pre-selected amount of additive is fixed at a first amount and the pre-selected amount of water varies and is selected for the pre-selected freezing point.

8. The cooling package of claim 1, wherein the temperature sensor comprising:

a cylindrical sensor probe extending a length.

9. A cooling package comprising:

a container having a top and a bottom connected by accordion-shaped walls to adjust a height of the container between the top and the bottom;

a water-soluble additive disposed inside the container wherein the additive is configured to be mixed with an amount of water such that the freezing point of the additive and water solution is at a pre-selected value;

a spout defined in the container for accessing the interior of the container;

a temperature sensor removably attached to the spout and having a tip extending into the container and offset from the bottom and the top of the container at a location known to freeze last;

a display in communication with the temperature sensor and indicating a temperature of the solution.

10. The cooling package of claim 9, further comprising a cap in threaded engagement with the spout, wherein the cap retains the temperature sensor to the spout.

11. The cooling package of claim 10, further comprising a gasket disposed between the spout and the temperature sensor, wherein the temperature sensor seals an opening in the spout.

12. The cooling package of claim 10, wherein the cap has a window and the display is visible through the window.

13. The cooling package of claim 9, where the temperature sensor probe comprises a cylindrical probe extending a length and having a tip that extends to a depth from the top to locate the tip at least half-way between a bottom and a top of the container.

14. The cooling package of claim 9, where the temperature sensor comprises a cylindrical probe extending a length and having a tip that extends to a depth from the top to locate the tip between the bottom and the top of the container.

* * * * *